US006246370B1

(12) United States Patent
Wixforth

(10) Patent No.: US 6,246,370 B1
(45) Date of Patent: Jun. 12, 2001

(54) MICROWAVE FLAT ANTENNA

(75) Inventor: Thomas Wixforth, Hildesheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/509,335

(22) PCT Filed: May 19, 1998

(86) PCT No.: PCT/DE98/01375

§ 371 Date: Mar. 24, 2000

§ 102(e) Date: Mar. 24, 2000

(87) PCT Pub. No.: WO99/16148

PCT Pub. Date: Apr. 1, 1999

(30) Foreign Application Priority Data

Sep. 24, 1997 (DE) ..... 197 42 090

(51) Int. Cl.[7] ..... H01Q 1/38
(52) U.S. Cl. ..... 343/700 MS; 343/853
(58) Field of Search ..... 343/700 MS, 853, 343/767, 770, 846, 848

(56) References Cited

U.S. PATENT DOCUMENTS 5,936,579 * 8/1999 Kapitsyn et al. ..... 343/700 MS
6,008,763 * 12/1999 Nystrom et al. ..... 343/700 MS
6,037,911 * 3/2000 Brankovic et al. ..... 343/795

FOREIGN PATENT DOCUMENTS 0 456 579 11/1991 (EP) .
0 543 519 5/1993 (EP) .
63 296402 3/1989 (JP) .

* cited by examiner

*Primary Examiner*—Tan Ho
(74) *Attorney, Agent, or Firm*—Kenyon & Kenyon

(57) ABSTRACT

A planar microwave antenna for receiving radio and television satellite signals, in which the antenna is associated with a main beam direction that is freely adjustable regardless of the position of the main plane of the antenna. The antenna is rotatable about its vertical axis, which is perpendicular to the main plane, and the main beam direction is adjustable in a plane running perpendicular to the main plane by adjusting phase shifting elements acting on the individual signals in the form of essentially U-shaped draw-out lines. The antenna may be a two-shell design, in which each of the two shells have individual antenna elements that are directed in different main mutually perpendicular directions. A decoupling element, which may include a round, hollow-cored conductor, may be mounted so that it is rotatable relative to the main plane of the antenna so that any linear polarization direction can be set.

11 Claims, 7 Drawing Sheets

MICROWAVE FLAT ANTENNA

FIELD OF THE INVENTION

The present invention concerns a microwave antenna having individual antenna elements linked together by lines of a defined length and arranged above a ground plane. The present invention further concerns a planar microwave antenna of the generic type, having a displaceable adjustment plane adjacent to the plane in which the individual antenna elements are arranged, in which the adjustment plane has structure that has a phase shifting effect on the individual signals carried over the lines. The generic antennas may be both sending and receiving antennas.

The Blaupunkt planar antenna A60-F is an example of planar microwave antennas of the generic type. Such planar microwave antennas may be used for.

Planar microwave antennas of the generic type are known in the related art, e.g., the Blaupunkt planar antenna A60-F. Such planar microwave antennas are intended primarily for replacing satellite dishes, which have become very popular in recent years, but their external appearance may cause criticism because it interferes aesthetically with the external appearance of buildings and landscapes. Such planar antennas must be aligned with the respective satellite whose signal is to be received with two degrees of freedom (which is also the case with the parabolic antennas mentioned above) in order to yield an antenna signal with an acceptable signal-to-noise ratio. The two degrees of freedom are usually referred to as elevation and azimuth, where elevation corresponds to an angle $\theta$ that is formed between the main beam direction and the main plane of the antenna, and the azimuth $\phi$ characterizes the rotation of the entire arrangement about a vertical axis. Other angle designations may be selected depending upon the position of the coordinate system described.

It is believed that the planar antennas available in the past could receive signals only in the direction of incidence perpendicular to their base area. Therefore, these antennas must also be aligned mechanically.

European Patent No. 456,579 A1 concerns a planar microwave antenna where the main beam direction can be adjusted without swiveling the main plane.

With such a system, there is an adjustment pane having a means or an arrangement, which is designed in the form of a wedge, is provided to act with a defined phase shift on the respective lines originating from the individual antenna elements. This makes it possible for angle $\theta$, which is formed between the main beam direction and the base plane of the planar antenna, to deviate from 90°.

When there is only one adjustment plane displaceable in one direction, such an antenna permits swiveling of the main beam direction in only one plane, the angle between the main beam direction and the base area of the antenna, which amounts to 90° with traditional planar antennas, optionally being modified to an acute or obtuse angle, but with the main beam direction always lying in the plane formed by the vertical axis and the direction of the ascending and descending phase offset of the individual signals.

In European Patent No. 0 456 579 A1, in order to permit any desired alignment of the main beam direction of the antenna in the hemispherical space spanned by the base area of the antenna, there are two adjustment planes arranged mutually perpendicular, thus permitting phase shifts of individual signals in two mutually perpendicular directions.

Such an antenna theoretically achieves the object of creating a planar antenna that can be mounted unobtrusively parallel to a wall or another flat surface, e.g., on residential buildings and the like, where the adjustable directional characteristic of the antenna ensures reception in any desired position or spatial orientation of the base area of the antenna.

However, the planar antenna having an adjustable directional characteristic, as in European Patent No. 0456 579 A1, has a few disadvantages which greatly limit its practical applicability. First, means which are to have a phase shifting effect on the individual lines run perpendicular to these lines, but the wedge-shaped design of the elements having a phase shifting effect, as in European Patent No. 0456579 A1, require a certain thickness of the adjustment plane and thus may pose problems from the standpoint of manufacturing technology.

In addition, the design having two adjustment planes arranged mutually perpendicular may be complicated and makes the antenna expensive.

SUMMARY OF THE INVENTION

Therefore, an object of an exemplary embodiment of the present invention is to improve upon an antenna of the specified generic type, so the phase shifting elements can be manufactured on the adjustment plane in a simpler manner and less susceptible to mechanical problems.

It is believed that this object may be achieved with a generic planar microwave antenna having lines that are in which each interrupted, each point of interruption is assigned an essentially U-shaped conductor section arranged on the displaceable plane. The active length of this U-shaped conductor section being variable by displacing the adjustment plane.

Due to the interruption provided in the lines, the essentially U-shaped conductor section assigned to each point of interruption functions at the same time like a variable draw-out line, so the transit time of the signal and thus its phase angle can be influenced. The phase shift/transit time elements provided on the adjustment plane according to an exemplary embodiment of the present invention may be arranged on the adjustment plane by various manufacturing techniques or conductor techniques, including microstrip lines, triplate lines or strip lines, suspended substrate lines, slot lines, coplanar lines, coplanar strip lines.

The adjustment plane is particularly preferably arranged between the ground plane and the plane of the individual antenna elements. The U-shaped conductor sections may be linked galvanically or by a mixture of inductive and capacitive coupling.

The angle between the main beam direction and the main plane of the antenna can be adjusted by displacing the adjustment plane, but preferably the adjustment plane is designed in the form of a foil having tension elements acting on its edges. Such tension elements may include, for example, screws arranged on opposite sides, permitting movement of the adjustment plane in the form of the foil in each case in one direction.

According to an exemplary embodiment of the present invention, precisely one adjustment plane may be provided to simplify the mechanical design of the antenna. To nevertheless allow the main beam direction to be directed in space at a given angle $\theta$ between the main beam direction and the antenna plane, a refinement of the planar microwave antenna according to an exemplary embodiment the present invention provides in that the antenna plane is mounted so it can rotate, so that an angle $\phi$ about the vertical axis is also adjustable.

In comparison with European Patent No. 0 456 579 A1, for example which defines the generic type, a simplified design is achieved in this way which can also be manufactured less expensively because of the specific design of the elements having a phase shifting effect while also being less susceptible to defects.

Another disadvantage of the planar antenna art of this generic type according to European Patent No. 0 456 579 A1 is that the planar element may be suitable only for left circular polarization (LHCP) and right circular polarization (RHCP).

Therefore, another object of an exemplary embodiment the present invention is to create a planar microwave antenna that is suitable for any types of polarization.

This object is achieved with a microwave antenna having individual antenna elements linked together by lines of a defined length and arranged above a ground plane, characterized by a two-shell design, each shell having at least one plane containing individual antenna elements, and in which the direction of the individual antenna elements of the first shell runs perpendicular to the preferred direction of the individual antenna elements of the second shell.

For a simples choice of the direction of polarization, for the summation signals of the first shell and the second shell may each sent to one of two decoupling contacts, which are arranged in a circular cutout where they are offset mutually by an angle $\pi/2$, and a hollow-cored conductor which is mounted so it can rotate in the circular cutout and which has a circular cross section and which has two corresponding decoupling contacts arranged so they are offset mutually by an angle $\pi/2$.

The method of achieving this object according to an exemplary embodiment of the present invention can be used to particular advantage with the microwave antenna proposed according to an exemplary embodiment of the present invention having an adjustable directional characteristic, where precisely one displaceable plane having essentially U-shaped conductor sections as the phase shifting elements is arranged on a main plane which can rotate so that the main beam direction can be adjusted with little effort. Due to the combination of these two measures, an antenna is created which is suitable for satellite reception and communication and similar applications, for example, where the antenna can be mounted unobtrusively parallel to any desired surface such as the wall of a house, a gable wall, etc. and yields a good signal-to-noise ratio of the antenna signal with any type of polarization.

DETAILED DESCRIPTION

Figure 1:
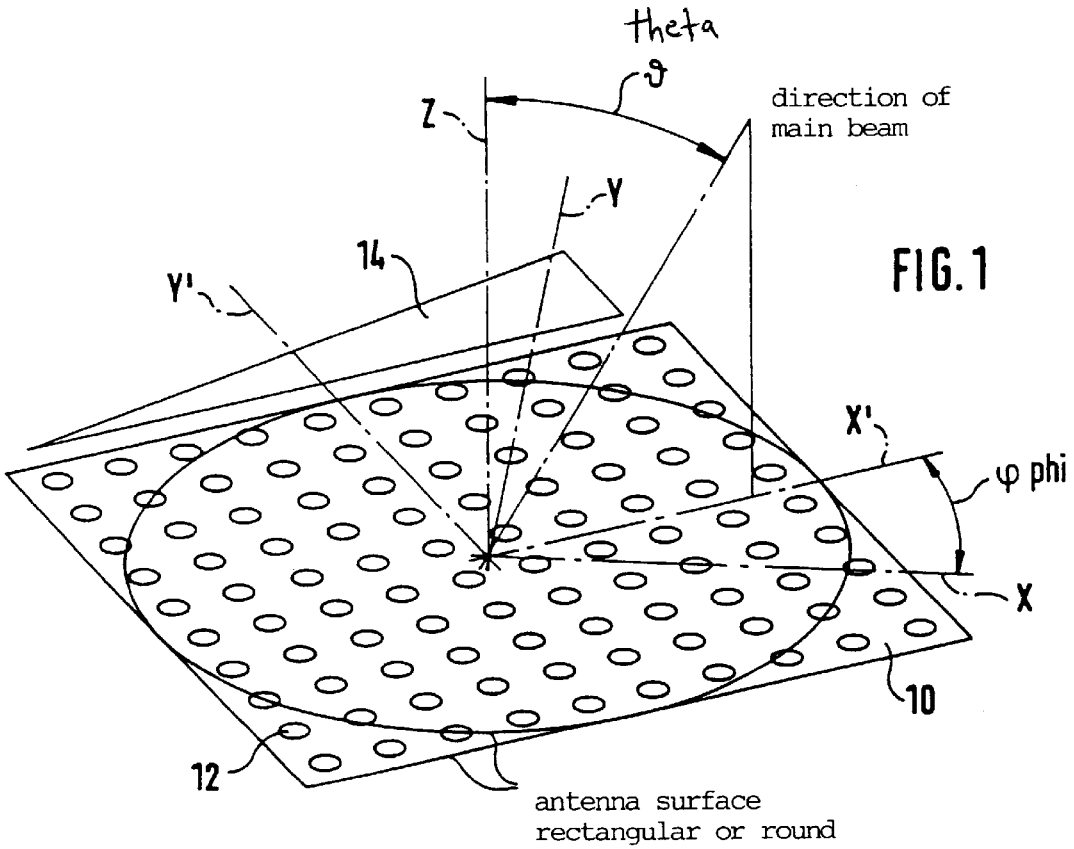
FIG. 1 shows a schematic diagram of the possible adjustments of the direction of the main beam with a planar antenna according to an exemplary embodiment of the present invention.

FIG. 1 shows a schematic diagram of the degrees of freedom provided according to an exemplary embodiment of the present invention for directing the main beam of a planar antenna 10 according to an exemplary embodiment of the present invention. Planar antenna 10 has, for example, 10×10 individual antenna elements which are indicated in FIG. 1 simply by one circle 12 for each. The edge of the antenna area may be rectangular, for example, as indicated in FIG. 1, i.e., according to a matrix of 10×10 individual antenna elements, or it may have a circular edge to permit the preferred rotation about the vertical axis (Z axis).

As shown in even greater detail in the following figures, an exemplary embodiment of the present invention provides for a defined phase shift to be induced in the direction of the X' axis for all individual antenna elements of the same coordinates, as represented by triangle 14. As a result, despite an angle of incidence deviating from the vertical by an angle $\theta$, all the individual signals of the individual antenna elements are in phase on reaching the summation point.

According to an exemplary embodiment of the present invention, only one adjustment plane has phase shifting elements. To permit swiveling of the direction of the main beam by an angle $\theta$ not only in the plane defined by the Z axis and the X' axis, an exemplary embodiment of the present invention provides for the entire antenna arrangement to be pivotable about the vertical axis, i.e., the Z axis, so the X' axis can be pivoted by an angle $\phi$ to the X axis. With a corresponding alignment of the antenna surface, angle $\phi$ may be an azimuth, for example.

It is believed that an exemplary embodiment of the present invention permits inexpensive antennas which can be mounted in any desired position on walls of buildings, in particular parallel to a wall of a building, with the direction of the main beam still being freely directable in space.

Figure 2:
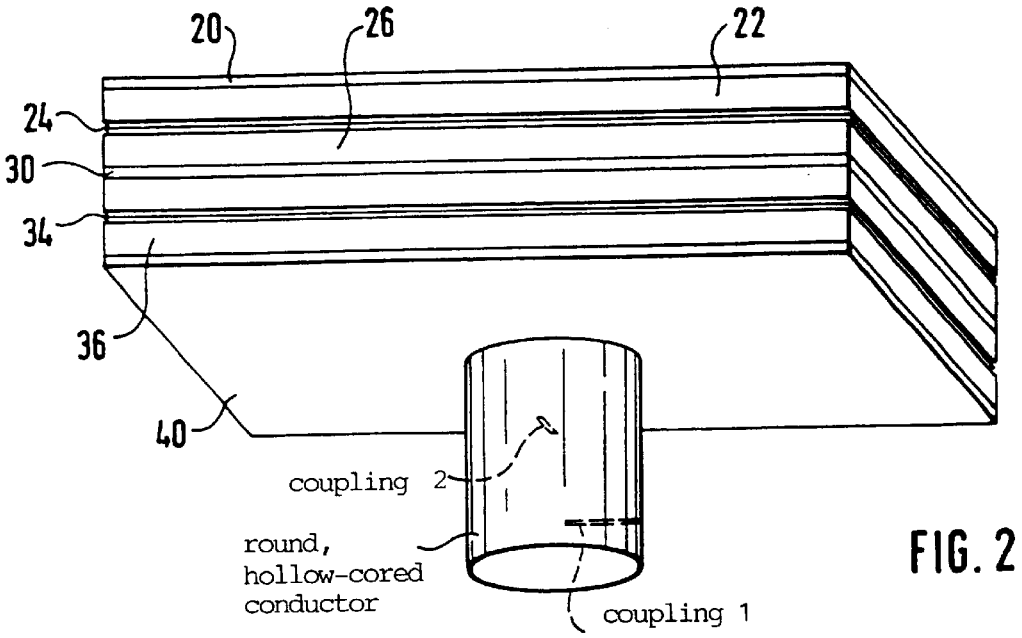
FIG. 2 shows a schematic perspective diagram of the layer structure of a planar antenna according to an exemplary embodiment of the present invention.
Figure 3:
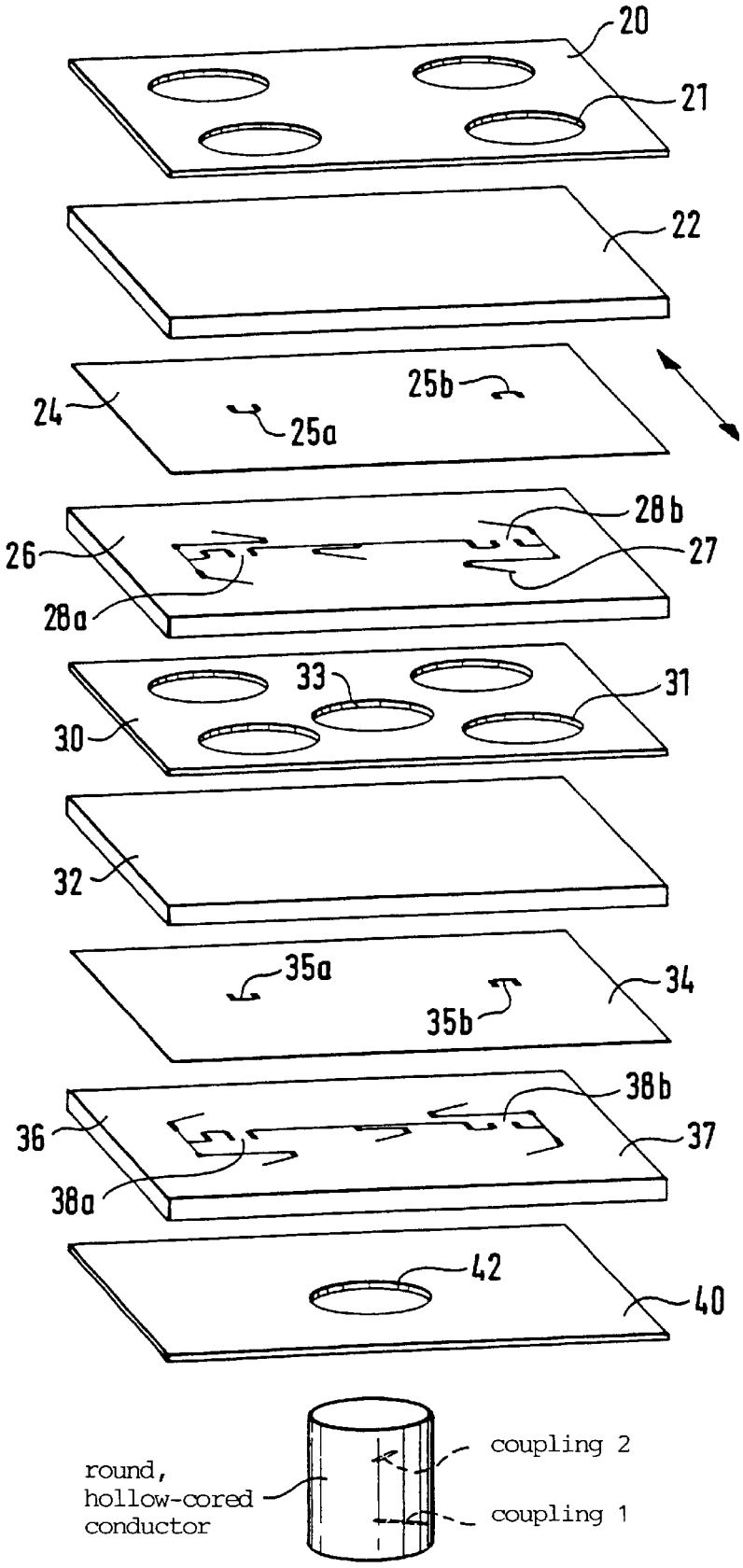
FIG. 3 shows the layer structure of FIG. 2 as an exploded drawing.

FIG. 2 shows the design of a planar antenna according to an exemplary embodiment of the present invention, and FIG. 3 shows the layers from FIG. 2 in an exploded diagram.

According to an exemplary embodiment of the present invention, a dual-shell design is provided so as to permit analysis of two mutually perpendicular polarization components and thus adjustment of any type of polarization. FIG. 2 shows the layers belonging to a top shell, labeled with numbers in the 20s, while the layers belonging to a bottom shell are labeled with numbers in the 30s.

From top to bottom, FIG. 2 shows first a metal layer 20 applied to a carrier material 22 referred to below as supersaturate 22. FIG. 3 shows that metal layer 20 has 2×2 circular cutouts 21. Each circular cutout is part of an individual antenna element. Representation of a 2×2 matrix of individual antenna elements has been selected for ease of understanding, but with actual embodiments of the antenna according to an exemplary embodiment of the present invention, the matrices of individual antenna elements would have to be much larger to obtain a sufficiently strong total signal, in particular with satellite reception.

Below supersaturate 22 there is a foil 24 which is displaceable in the direction of the arrows in FIG. 3. Essentially U-shaped conductor sections 25*a* and 25*b* whose function will be explained in the discussion of the next layer, substrate 26, are arranged on foil 24. Substrate 26 has a network structure having individual antenna elements 27, all of which are aligned in one parallel direction. Lines which are interrupted at two locations 28*a* and 28*b* lead away from individual antenna elements 27 which work together with corresponding circular cutouts 21 in metal layer 20. These points of interruption are bridged by U-shaped conductor sections 25*a* and 25*b*, and the effective length of U-shaped "draw-out lines" 25*a* and 25*b* can be altered by the position of foil 24. For example, if foil 24 shown in FIG. 3*b* is shifted toward the upper edge of the drawing, the effective length of phasing line 25*a* is increased, while that of line 25*b* is decreased. Accordingly, this yields a phase difference angle, because signals originating from the individual antenna elements at the left in FIG. 3 have traveled a greater distance than signals originating from the individual antenna elements at the right in the same figure.

The same structure is repeated in the bottom layers, where metal layer 30 also has a central orifice 33 to allow access to a decoupling contact 29 arranged on substrate 26.

In contrast with the network structure having individual antenna elements 27 arranged on substrate 26, individual antenna elements 37 which each work together with cutouts 31 in metal layer 30 are aligned in a direction perpendicular to the former individual antenna elements 27.

Likewise, decoupling contact 39 runs at an angle $\pi/2$ to decoupling contact 29.

At the bottom layer base plane 40, a round hollow-cored conductor 42 can be seen which can rotate with respect to base plane 40 according to the present invention and works together with decoupling contacts 29 and 39 of the two shells arranged mutually offset by $\pi/2$.

Figure 4:
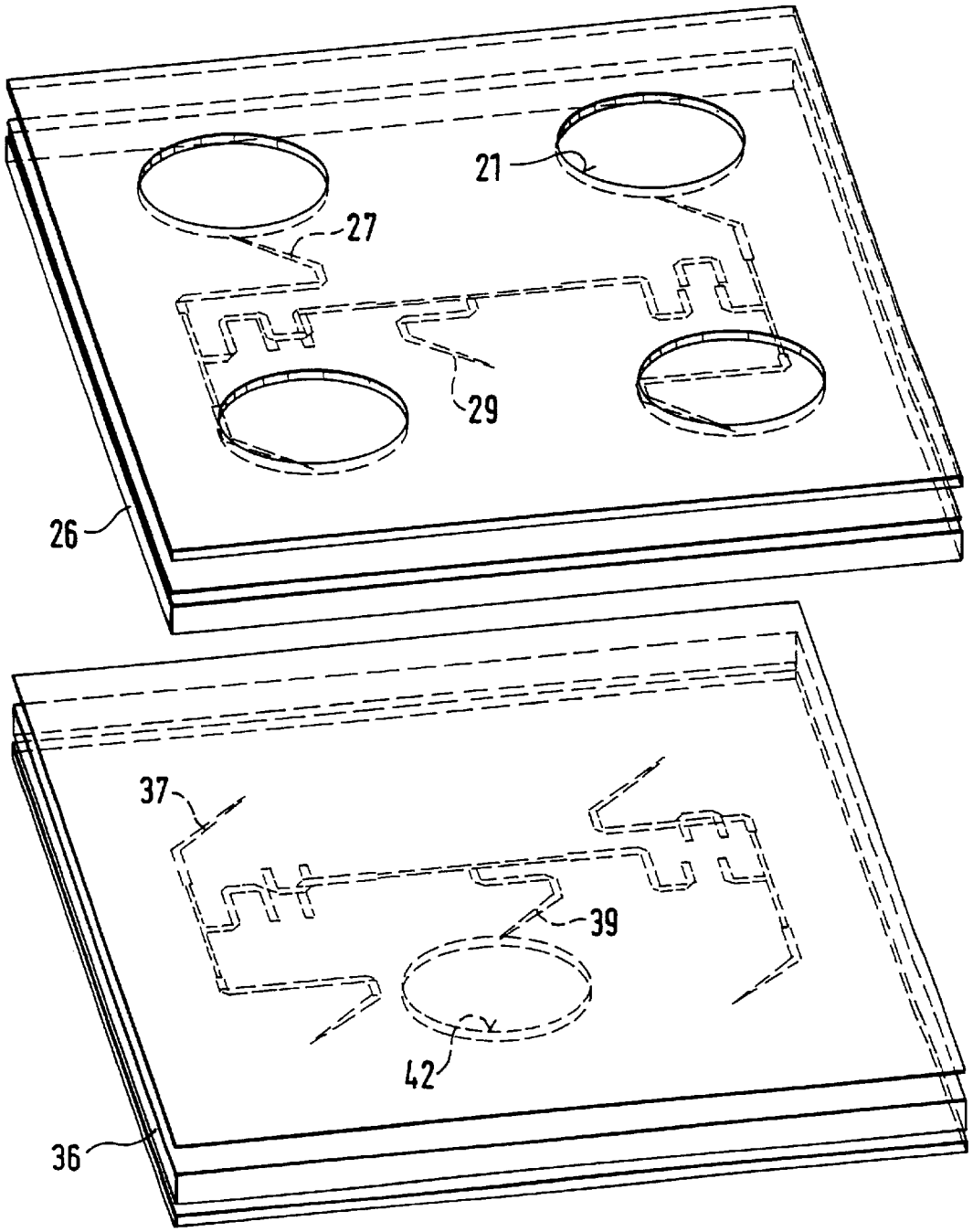
FIG. 4 shows a perspective schematic diagram of the two shells with antenna elements arranged so that they are offset mutually by an angle $\pi/2$.

FIG. 4 shows four individual antenna elements each in the upper and lower shells, in perspective view, arranged one above the other. It can be seen here that individual paired antenna elements 27 and 37 are arranged in mutually perpendicular polarization directions. It can also be seen here that the projections of decoupling contacts 29 and 39 of the upper and lower shells are arranged at an angle of $\pi/2$. In addition, this also shows rotatably arranged round hollow-cored conductor 42 with which the total summation signal is output.

Figure 5:
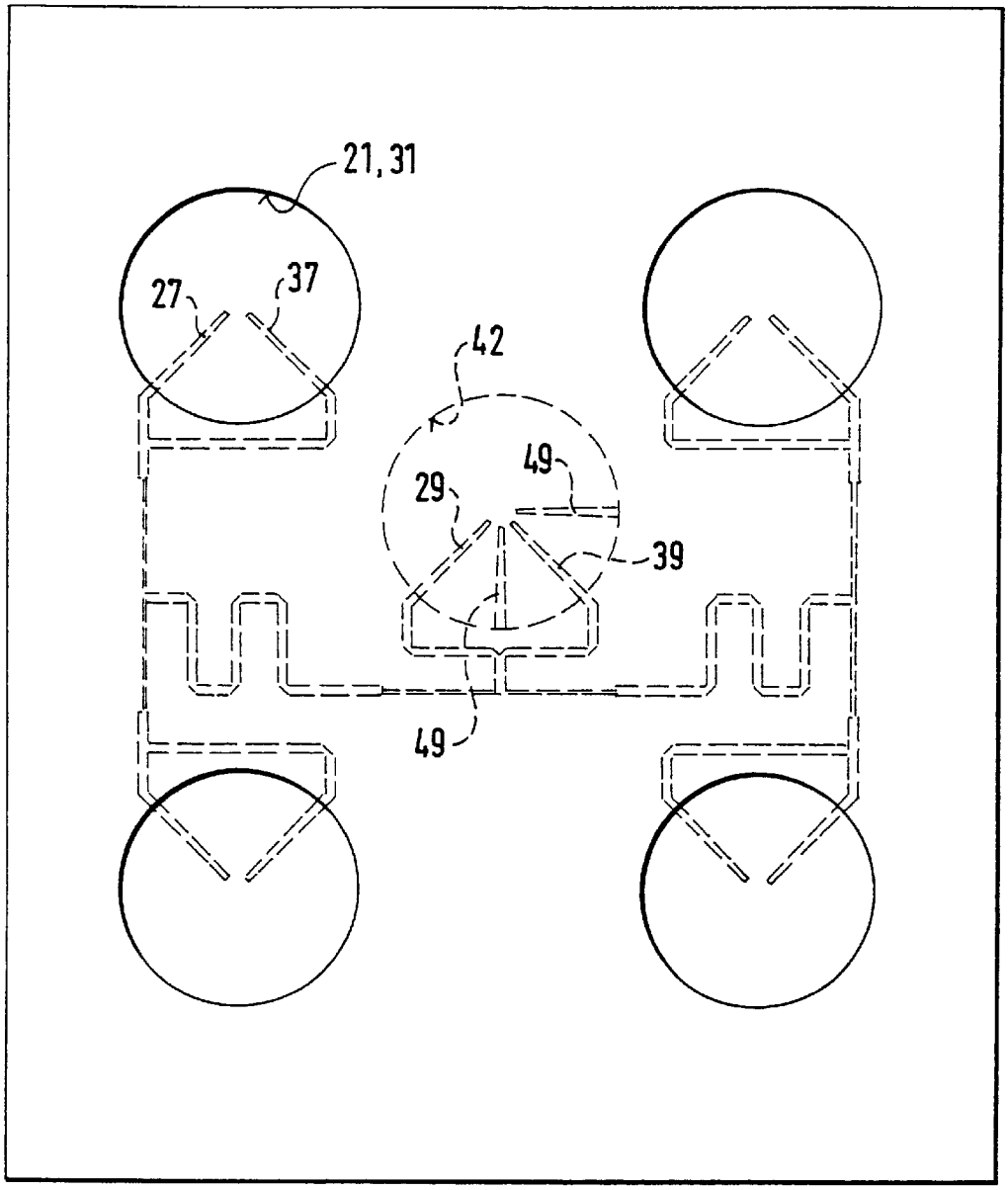
FIG. 5 shows the diagram of FIG. 4 as seen from above with the decoupling contacts of a central hollow-cored conductor shown in a first position.

FIG. 5 shows the diagram according to FIG. 4 in the form of a projection, with the direction of the projection being parallel to the vertical axis, i.e., the Z axis. The planes of the first and second shells which are spaced a distance apart in space therefore appear fused together in the view from above in FIG. 5. FIG. 5 also shows two decoupling contacts 49 arranged on round, hollow-cored conductor 42 with a mutual spacing of $\pi/2$, like decoupling contacts 29 of the top shell and 39 of the bottom shell. In the position shown in FIG. 5, the signal of the vertically polarized wave component (vertical with respect to this view) can be output at the decoupling contact shown in the perpendicular position. Accordingly, the signal of the horizontally polarized wave component is available at the other decoupling contact 49.

Figure 6:
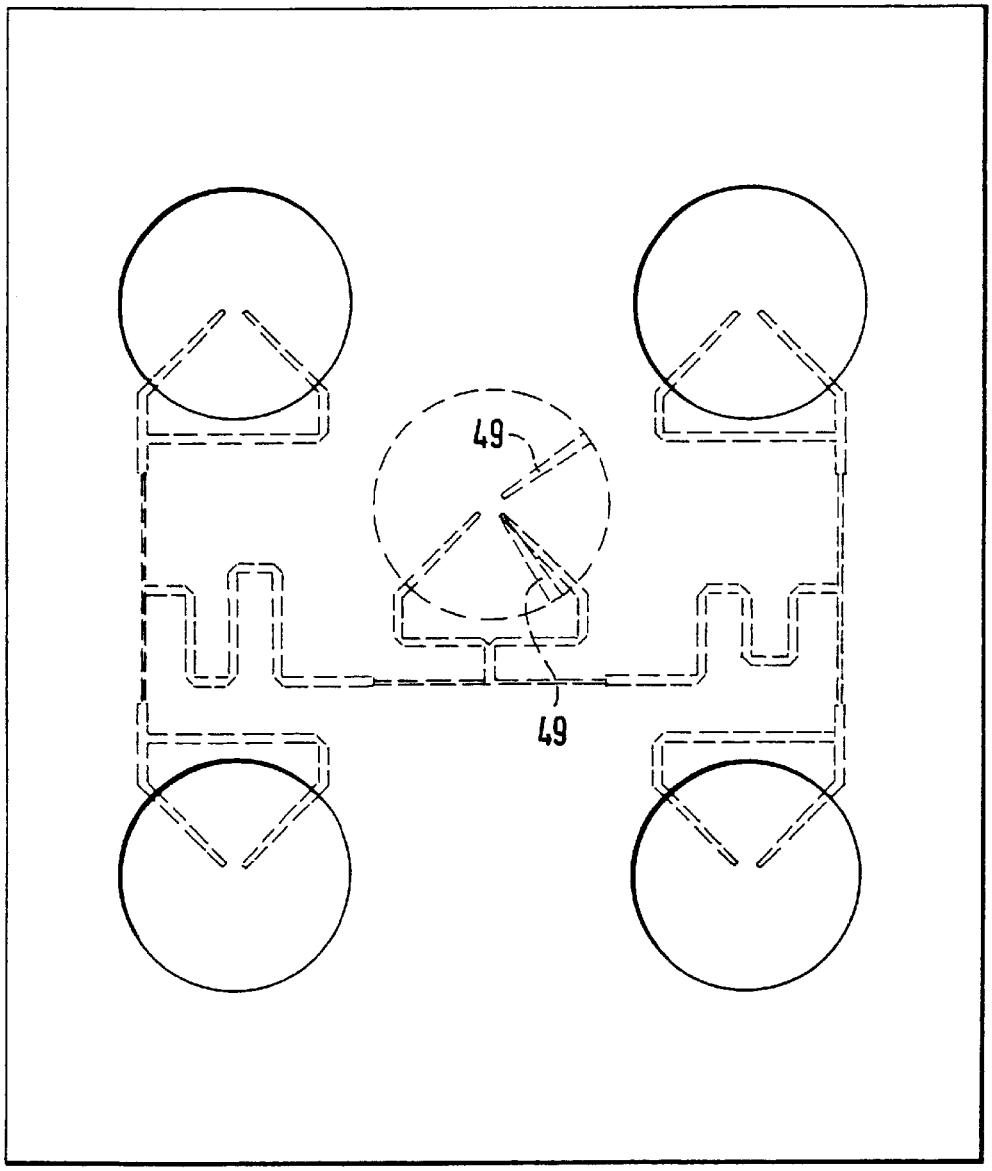
FIG. 6 shows the diagram of FIG. 5 in which the decoupling points are offset to allow reception of another plane of polarization.

FIG. 6 shows round hollow-cored conductor 42 rotated relative to the antenna surface, so that signals of horizontally and vertically polarized wave components with respect to a plane of incidence inclined with respect to this view are available at decoupling contacts 49.

For linear forms of polarization, any desired plane of polarization can accordingly be set by rotating round, hollow-cored conductor 42.

If the signals supplied by the two shells are coupled by inserting a 90° phase shift device, a circularly polarized signal can also be processed with the planar antenna according to an exemplary embodiment of the present invention, because circularly polarized waves may be composed of any two perpendicular linear wave components. If the decoupling contacts are wired to the round, hollow-cored conductor terminal in such a way as to yield circular polarization, the rotation or the angle to the main plane of the antenna is irrelevant.

The antenna according to an exemplary embodiment of the present invention provides the inexpensive possibility of creating a universal antenna for satellite reception in particular which can be arranged in any desired position, i.e., in an aesthetically satisfactory manner, can be directed at a satellite whose signals are to be received and can be switched to different forms of polarization by using relatively simple means or structures.

Figure 7:
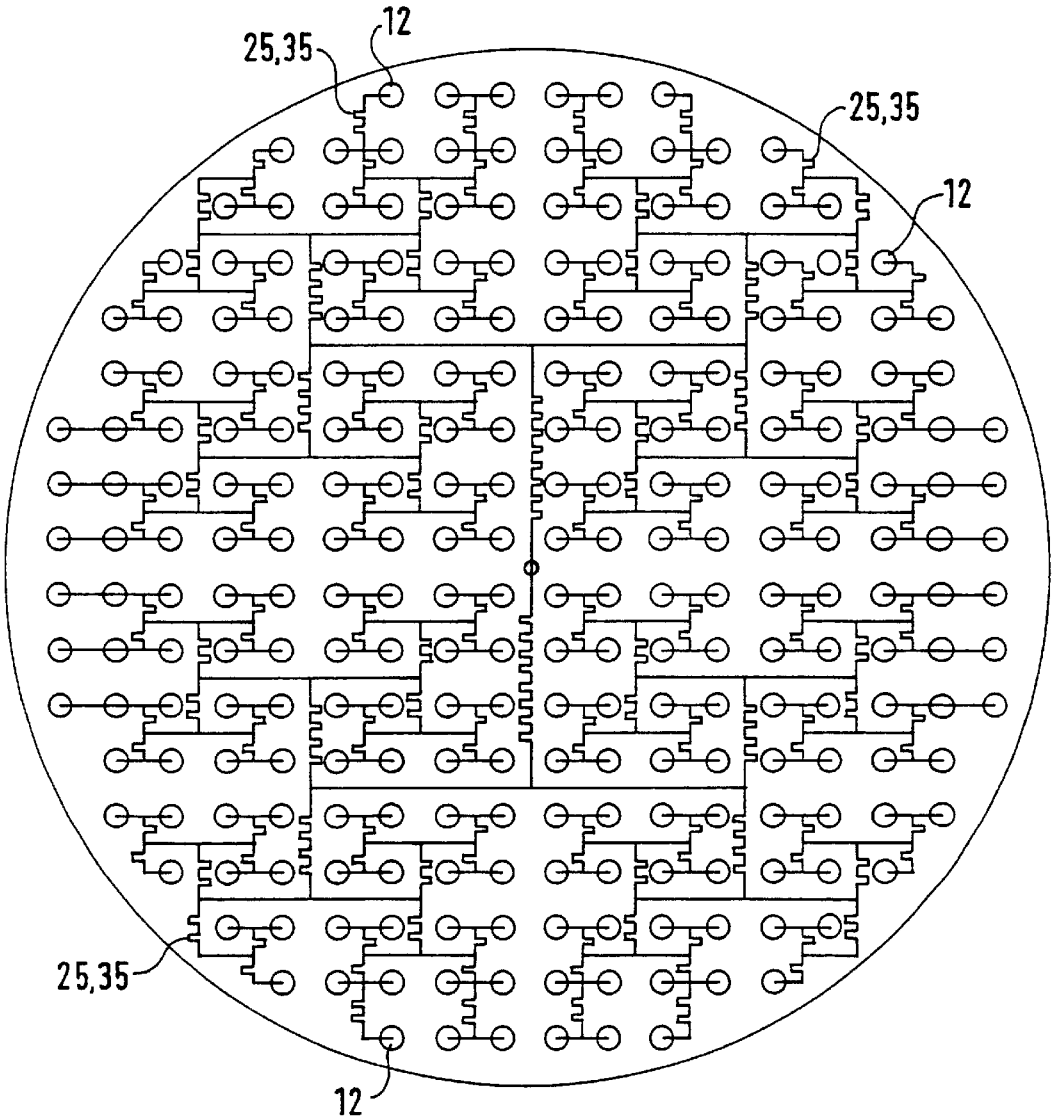
FIG. 7 shows a schematic diagram of an exemplary design of a binary tree structure having individual antenna elements and phase shifting elements, in which the antenna edge is circular.
Figure 8:
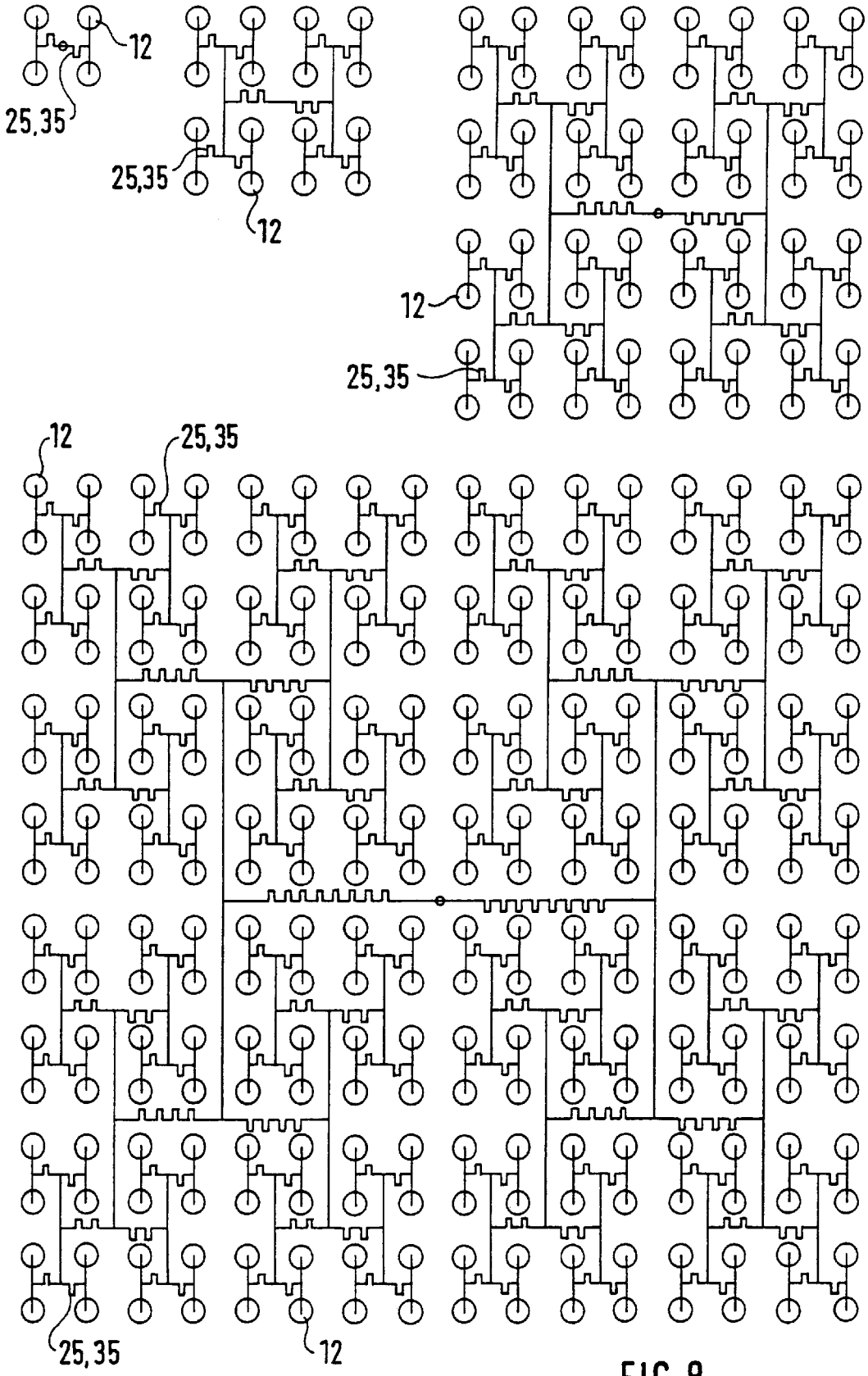
FIG. 8 shows examples of binary tree structures and an arrangement of phase shifting elements with various quadratic numbers of individual antenna elements.

FIGS. 7 and 8 show examples of the binary tree structure and the arrangement of phase shifting "draw-out lines." FIG. 7 shows an arrangement where the individual antenna elements are represented by circles 12, with phase shifting elements 25 of the first shell and 35 of the second shell being indicated by corresponding U-shaped segments. FIG. 7 also shows the circular border of the antenna plane which facilitates rotation about the vertical axis (shown perpendicular to the plane of the drawing in FIG. 7).

In a similar symbolic representation, FIG. 8 shows, for example, conceivable matrices or binary tree structures for 2×2 antenna elements, 4×4, 8×8 and 16×16 antenna elements. The size of the matrix of antenna elements can be selected as desired, but preference is given to quadratic arrangements.

What is claimed is:

1. A planar microwave antenna, comprising:

individual antenna elements linked together by lines having a defined length and situated in another plane above a ground plane; and a displaceable adjustment plane situated adjacent to the another plane in which the individual antenna elements are situated, wherein the displaceable adjustment plane includes means for providing a phase shifting effect on individual signals carried over the lines;

wherein:

the lines are each interrupted at points of interruption, each of the points of interruption being bridged by an essentially U-shaped conductor section situated on the displaceable adjustment plane, and the effective length of the essentially U-shaped conductor section is variable by displacing the displaceable adjustment plane.

2. The planar microwave antenna of claim 1, wherein the displaceable adjustment plane is situated between the ground plane and the another plane in which the individual antenna elements are situated.

3. The planar microwave antenna of claim 1, wherein ends of each point of interruption are galvanically linked to an assigned respective essentially U-shaped conductor section on the displaceable adjustment plane.

4. The planar microwave antenna of claim 1, wherein ends of each point of interruption are linked one of inductively and capacitively to an assigned respective essentially U-shaped conductor section on the displaceable adjustment plane.

5. The planar microwave antenna of claim 1, wherein an angle between a main beam direction and an antenna plane is adjustable by displacing the displaceable adjustment plane.

6. The microwave antenna of claim 5, wherein the displaceable adjustment plane is in the form of a foil having hinged tension elements at its edges so as to be adjustable.

7. The planar microwave antenna of claim 5, further comprising means for directing the main beam direction in space at the angle between the main beam direction and the antenna plane.

8. The planar microwave antenna of claim 7, wherein the antenna plane is mounted so that it is rotatable.

9. The planar microwave antenna of claim 1, wherein the planar microwave antenna includes a circular edge.

10. The planar microwave antenna of claim 1, wherein:

the planar microwave antenna includes first and second shells, each shell having at least one plane containing the individual antenna elements and the displaceable adjustment plane; and a polarization direction of the individual antenna elements associated with the first shell runs perpendicular to another polarization direction of the individual antenna elements associated with the second shell.

11. The planar microwave antenna of claim 1, wherein:

the planar microwave antenna includes a first shell and a second shell; and summation signals of the first shell and the second shell are sent to at least one of two decoupling contacts, which are arranged in a circular cutout where the two decoupling contacts are offset mutually by an angle $\pi/2$, and to a hollow-cored conductor, which is mounted so that it is rotatable in the circular cutout and which has a circular cross section having two corresponding decoupling contacts arranged so that the two corresponding decoupling contacts are offset mutually by an angle $\pi/2$.

* * * * *

UNITED STATES PATENT AND TRADEMARK OFFICE

CERTIFICATE OF CORRECTION

PATENT NO. : 6,246,370 B1
DATED : June 12, 2001
INVENTOR(S) : Wixforth, T.

It is certified that error appears in the above-identified patent and that said Letters Patent is hereby corrected as shown below:

Title page, Item [54] and Column 1, line 1,
Change the title to read -- PLANAR MICROWAVE ANTENNA --.

Column 1,
Line 14, insert -- BACKGROUND INFORMATION --
Line 16, change "for." to -- for --
Delete lines 17, 18 and 19
Line 40, change "No. 456,579" to -- No. 0 456 579 --
Line 43, change "pane" to -- plane --

Column 2,
Line 11, change "0456579" to -- 0 456 579 --

Column 3,
Line 22, change "simples" to -- simpler --

Column 4,
Line 57, change "supersaturate" to -- superstrate --
Line 66, change "supersaturate" to -- superstrate --

Signed and Sealed this

Twelfth Day of November, 2002

*Attest:*

*Attesting Officer*

JAMES E. ROGAN
*Director of the United States Patent and Trademark Office*